US008656522B2

(12) United States Patent
Leibfried

(10) Patent No.: US 8,656,522 B2
(45) Date of Patent: Feb. 25, 2014

(54) TOILET AND TOILET SEAT MOUNTING SYSTEM

(76) Inventor: Michael R. Leibfried, Lancaster, WI (US)

( * ) Notice: Subject to any disclaimer, the term of this patent is extended or adjusted under 35 U.S.C. 154(b) by 1127 days.

(21) Appl. No.: 12/625,668

(22) Filed: Nov. 25, 2009

(65) Prior Publication Data

US 2010/0125935 A1 May 27, 2010

Related U.S. Application Data

(60) Provisional application No. 61/118,321, filed on Nov. 26, 2008.

(51) Int. Cl.
*A47K 13/12* (2006.01)

(52) U.S. Cl.
USPC ..... 4/236

(58) Field of Classification Search
USPC ..... 4/234–241
See application file for complete search history.

(56) References Cited

U.S. PATENT DOCUMENTS

| | | | |
|---|---|---|---|
| 651,354 | A | 6/1900 | Hogan |
| 2,004,023 | A | 6/1935 | Uffen |
| 2,593,534 | A | 4/1952 | Campanelli |
| 2,849,728 | A | 9/1958 | Gyllenberg |
| 3,055,015 | A | 9/1962 | Silverman |
| 3,063,063 | A | 11/1962 | Brooks |
| 3,550,164 | A | 12/1970 | Pease |
| 3,613,130 | A | 10/1971 | Sansone |
| 3,623,767 | A | 11/1971 | Condon |
| 4,291,422 | A | 9/1981 | Shoemaker |
| 4,326,307 | A | 4/1982 | Baillie et al. |
| 4,367,567 | A | 1/1983 | Sendoykas |
| 4,884,841 | A | 12/1989 | Holley |
| 4,970,731 | A | 11/1990 | Fait |
| 5,063,617 | A | 11/1991 | Ward et al. |
| 5,091,999 | A | 3/1992 | Turner, Jr. |
| 5,212,840 | A | 5/1993 | Caldwell |
| 5,638,554 | A | 6/1997 | Corzine |
| 5,720,753 | A | 2/1998 | Sander et al. |
| 5,775,863 | A | 7/1998 | Anderson |
| 5,946,740 | A | 9/1999 | Sorimachi |

(Continued)

FOREIGN PATENT DOCUMENTS

| | | |
|---|---|---|
| CA | 2305976 | * 10/2001 |
| CH | 689138 | * 10/1998 |

(Continued)

OTHER PUBLICATIONS

International Search Report and Written Opinion for PCT/US2006/40618, mailed Apr. 23, 2007.

(Continued)

*Primary Examiner* — Lori Baker
(74) *Attorney, Agent, or Firm* — Foley & Lardner LLP

(57) ABSTRACT

A toilet mounting hinge includes post holders; an elongate post secured to and extending downwardly from each of said post holders; a post receptacle; and said elongate posts passing through and beyond said post receptacles and configured to permit a toilet seat to be slidably elevated above a toilet bowl to a maintenance position, and having a distal end configured to engage the receptacle in the maintenance position and to releasably support the elongate post in said maintenance position; wherein each of said post receptacles comprises a receptacle head, a threaded sleeve, and an insert liner.

20 Claims, 18 Drawing Sheets

(56) References Cited

U.S. PATENT DOCUMENTS

| | | | | |
|---|---|---|---|---|
| 6,012,886 | A | 1/2000 | Tanamura et al. | |
| 6,070,295 | A | 6/2000 | Hulsebus | |
| 6,101,640 | A | 8/2000 | Brewer et al. | |
| 6,112,335 | A | 9/2000 | Gaston | |
| 6,338,167 | B1 | 1/2002 | Baker et al. | |
| 6,643,851 | B1 | 11/2003 | Janes | |
| 6,754,917 | B1 | 6/2004 | Rhoades | |
| 6,763,529 | B1 | 7/2004 | Richter | |
| 6,807,686 | B1 | 10/2004 | Janes | |
| 2003/0182719 | A1 | 10/2003 | Glesson | |
| 2004/0223829 | A1 | 11/2004 | Barnett et al. | |
| 2006/0260029 | A1* | 11/2006 | Kelly | 4/240 |

FOREIGN PATENT DOCUMENTS

| | | |
|---|---|---|
| DE | 43 39 200 | 5/1999 |
| DE | 100 38 601 | 2/2002 |
| FR | 2770388 | 5/1999 |

OTHER PUBLICATIONS

International Search Report for PCT/US2007/80176, mailed Apr. 15, 2008.

Translation of First Office Action in Chinese Appln. No. 200680047154.X dated Jan. 8, 2010.

English abstract for Swedish Patent No. Ch 689138.

* cited by examiner

Fig. 3
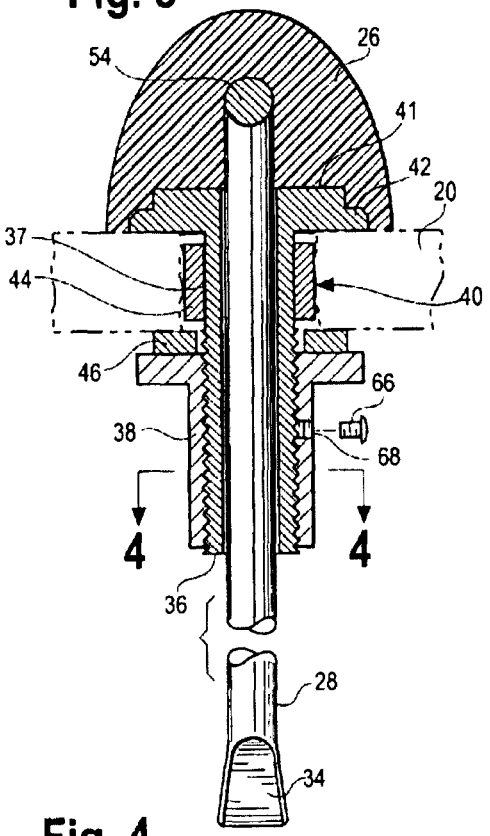
Fig. 6
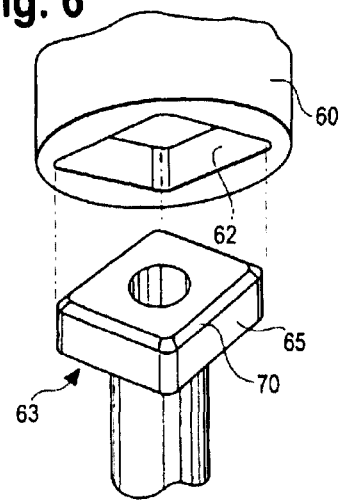
Fig. 7
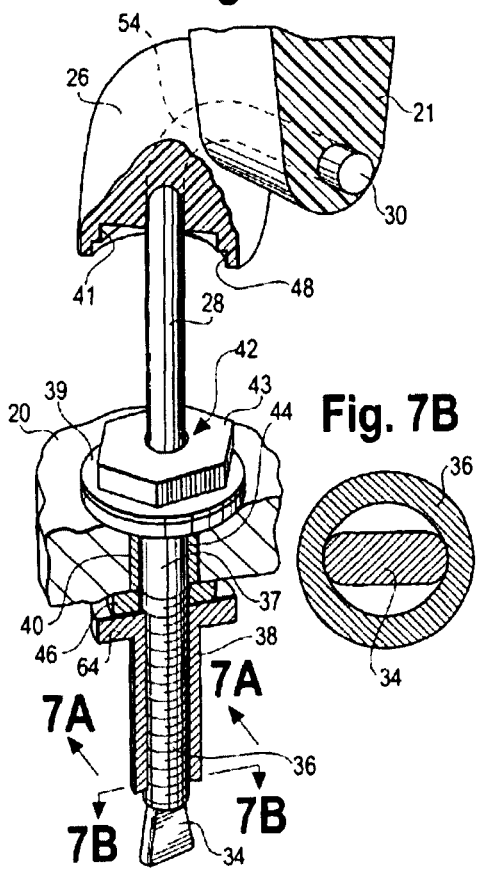
Fig. 4
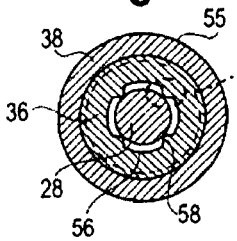
Fig. 5
Fig. 7A
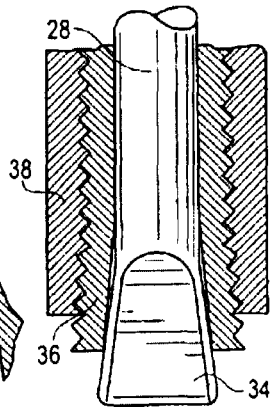
Fig. 5
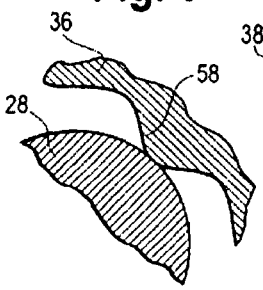
Fig. 7B

TOILET AND TOILET SEAT MOUNTING SYSTEM

CROSS-REFERENCE TO RELATED APPLICATIONS

This application claims the benefit of U.S. Provisional Application No. 61/118,321, filed Nov. 26, 2008, which is incorporated herein by reference, in its entirety, for any and all purposes.

BACKGROUND

Improving the maintenance, the cleanliness and the sanitation features of conventional toilets and toilet seats has been the subject of many efforts to provide improved toilet seats, toilet bowls and means for connecting them. It has been found that cleaning and sanitizing is complicated by the intricacies of hinge-like interconnections between the pivoted seat ring and the bowl flange of a toilet bowl and by the inconvenient location and the often unsavory condition thereof. In many installations, the problems are aggravated by the hinge-like interconnection of a separate seat cover mounted above the seat. Access to the area around those interconnections is difficult and inconvenient and maintenance in that area is often distasteful. Partial solutions to these problems have been suggested by many.

One early effort to gain accessibility to the seat, bowl flange and the mounting area to facilitate maintenance is shown in a 1962 patent, U.S. Pat. No. 3,055,015. Bushings are bolted in the bowl flange apertures and a post extends from the seat through each bushing to connect the seat to the bowl flange. A spring arm on each post engages the bushing to releasably hold the seat in place on the bowl flange. The seat can be released and pulled upwardly to totally remove the seat for maintenance. This approach presents additional problems for maintenance personnel. Typically, the unsanitary separated seat assembly must be placed on a remote surface for cleaning and sanitizing. This results in excessive handling and touching of contaminated toilet seats, and subjects additional surface areas to contamination. The open apertures in the bowl flange bushing will collect debris and cleaning materials that are difficult to remove. Moreover, a configuration relying on total separation of the seat assembly from the toilet bowl will be more subject to vandalism and theft, especially in commercial applications.

Many years later, another approach to the same problems was shown in a 1980 patent, U.S. Pat. No. 4,326,307. In that approach, a bolt is secured in each bowl flange aperture with a mounting ball on the bolt above the bowl flange of a residential toilet. This does seal the apertures in the bowl flange against contamination. The seat is supported on each bowl flange ball by a mating hinged fastener. The fastener has a tab and side walls enclosing a slotted socket that engages the associated ball. For maintenance, the seat must be pulled from the bowl flange by lifting the tabs and separating the sockets from the balls. Such arrangements also present the problems of excessive handling and touching of the unsanitary detached seat, or seat and cover assembly, and a tendency to place it on remote surfaces for cleaning and sanitizing. Such an approach using releasable fasteners creates additional new problems. The protruding bowl flange ball creates new problems in bowl flange maintenance and the complex exposed fastener with a tab and socket present additional difficulties in removing and remotely resting the seat for maintenance. Other arrangements for detachment and remote storage of a toilet seat are found in the prior art for residential type toilet seats having two hinges, releasably connected to a device secured to the bowl flange.

SUMMARY

In one aspect, a toilet seat mounting system is provided that employs either "commercial style" or "residential style" toilet seats. In one embodiment, a mounting system is provided that maintains a toilet seat, or seat and cover, in three distinct positions. The system includes apparatus that maintains the seat or the seat and cover in the conventional use position or down position, aligned with and supported on the bowl flange. The apparatus also permits rotation of the cover, or the seat and cover, to a conventional over center storage position. In addition to the conventional use position and the conventional over center storage position, the apparatus of the invention is unique in that it permits controlled upward movement of the seat or the seat and cover to an unconventional elevated over center maintenance position substantially above the bowl flange. This unique position maximizes exposure of the seat, the cover and the bowl for maintenance. This facilitates cleaning the toilet bowl and bowl flange, the toilet seat and cover, the seat mounting system and the surrounding environment, without the need to detach the seat, or the seat and cover, from the toilet bowl fixture.

The toilet mounting system provides increased stability and rigidity of the seat, or seat and cover, when resting on the bowl flange in both the conventional use position and in the over-center storage position. Moreover, the mounting system provides positive support of the seat, or seat and cover, in the maintenance position above the bowl flange providing enhanced clearance and access, to better facilitate cleaning and maintenance. This ease of access is accomplished with a system comprising two elongate posts each extending downwardly from an over-molded post holder that rests on the bowl flange. Each post extends downwardly from the mounting apparatus and each is slidably mounted in a respective post receptacle which passes through and is positively secured within a toilet bowl flange aperture. Two vertical posts may be integrated into a single elongate double post holder extending between the bowl apertures. The double post holder may interface with a seat and cover in the conventional way using one or two hinge pins to allow the seat and the cover to rotate independently. Alternatively, the double post holder may be integrally molded with the seat and cover mounting apparatus in a more unconventional method such as a flexible hinge or "live hinge" without hinge pins connecting the double post holder, seat and cover to facilitate independent rotation of the seat and cover to their respective positions.

Each post receptacle is rigidly secured in the bowl flange aperture with a bushing to insure a positive rigid location of the receptacle. Each receptacle is secured and fastened in the respective bowl flange aperture by a threaded receptacle retainer. The post receptacles and receptacle retainers provide adequate fastening and support for the entire assembly and close the bowl flange apertures against contamination. The post receptacles are internally configured to insure a sliding fit with the posts. Each post has distal interference means, or distal end, which releasably engages the receptacle to, in turn, releasably support the post in the elevated maintenance position. The seat, or seat and cover, are easily raised to the elevated cleaning and maintenance position and lowered to rest on the bowl flange when and as desired. Each post receptacle has a receptacle head, an insert liner, and a threaded sleeve. Such a configuration allows for the threaded sleeve to be made from a metal or high impact plastic such that when secured to the toilet flange with the threaded receptacle retainer via high torque, the post receptacle is not deformed to cause binding with the posts. For example, the threaded receptacle retainer, or other securing nut or device, may be tightened to a torque of 50 ft-lbs, or more.

In another aspect, a toilet mounting hinge is provided separately from the toilet or system as a whole. The hinge may include post holders, an elongate post secured to and extending downwardly from each of the post holders, a post receptacle. The elongate posts pass through and beyond the post receptacles, and are configured to permit a seat to be slidably elevated above a toilet bowl a maintenance position. Each of said post receptacles has a receptacle head, a threaded sleeve, and an insert liner.

In another aspect, a nest is described for use in a toilet seating mounting apparatus. The nest is used in conjunction with a hinge shroud, such that when the hinge shroud and toilet seat mount are engaged, the nest aligns the apertures for easy insertion of a hinge rod upon which the toilet seat and cover would rotate.

Also provided are alternative configurations for the securing of posts to post holders in the toilet seat hinges and mounting means described. For example, the posts may be screwed into the post holders via threading on the post and in the post holder, or the post may be over-molded into the post holders via a head on the post.

In one aspect, a toilet includes a toilet bowl having a bowl flange with apertures; a toilet seat including a seat ring and a seat mount, and seat mounting apparatus; said seat mounting apparatus including said seat mount, post holders overlying the flange apertures, a connector joining said seat mount and said post holders to permit rotation of the seat ring between a generally horizontal use position and an over center storage position, and an elongate post secured to and extending downwardly from each of said post holders; a post receptacle secured in each of the bowl flange apertures and extending there beyond; and a cylindrical receptacle retainer surrounding and engaging each post receptacle over most of its length and engaging the underside of the bowl to secure the post receptacle in the bowl flange aperture; said elongate posts passing through and beyond the post receptacles, configured to permit the seat to be slidably elevated above the bowl flange to a maintenance position, and having a distal end configured to engage the receptacle in the maintenance position and to releasably support the elongate posts in said position for cleaning and maintenance; where the post receptacle includes a receptacle head, a threaded sleeve, and an insert liner.

In some embodiments, the threaded sleeve is a threaded metal sleeve. In other embodiments, the receptacle head includes a recessed area, and the post receptacle further includes a nut configured to screw onto the threaded metal sleeve, and to be received by the recessed area of the receptacle head. In some embodiments, the receptacle head and the insert liner are separate parts. In other embodiments, the insert liner includes a hollow shaft having a first end having a proximal shoulder and a second end having a distal shoulder. In yet other embodiments, the insert liner includes a hollow shaft having a first end and a second end, and a crush cut-out.

In some embodiments, the toilet includes a seat cover having a cover mount, said cover overlying said seat in the use position where said mounting apparatus includes said cover mount; and said connector joins said seat, cover and post holders to permit independent rotation of said seat ring and said seat cover between generally horizontal positions on said bowl flange and over center storage positions. In some embodiments, the distal end includes a flared blade of said elongate post. In some other embodiments, said elongate posts are secured to each of said post holders via a threaded end of each of said elongate posts and a threaded recessed area in each of said post holders. In some embodiments, the seat mount includes a hinge shroud, a hinge shroud sleeve, and a nest, said nest configured to receive the hinge shroud sleeve. In some embodiments, each cylindrical receptacle retainer is engaged to each post receptacle via threading, and each cylindrical receptacle retainer is configured to be tightened on the each post receptacle to a torque of greater than 50 in-lbs.

In another aspect, a system is provided for supporting and selectively positioning a toilet seat including a seat mount and a seat ring configured to rest on a toilet bowl flange having apertures. In some embodiments, the system includes seat mounting apparatus including the seat mount, post holders overlying the bowl flange apertures, a connector joining said seat mount and the post holders to permit rotation of the seat ring between a generally horizontal use position and an over center storage position, and an elongate post secured to and extending downwardly from each of said post holders; a post receptacle secured in each of the bowl flange apertures and extending there beyond; a cylindrical receptacle retainer surrounding and engaging each post receptacle over most of its length and engaging the underside of the bowl flange to secure the receptacle in the flange aperture; said elongate posts passing through and beyond the post receptacles, configured to permit the seat to be slidably elevated above the bowl flange to a maintenance position and having a distal end configured to engage the receptacle in the maintenance position and to releasably support the post in said position for cleaning and maintenance; where each post receptacle includes a receptacle head, a threaded sleeve, and an insert liner. In some embodiments, the system includes a seat cover having cover mount, said cover overlying said seat in the use position where: said mounting apparatus includes said cover mount; and said connector joins said seat, cover and post holders to permit independent rotation of said seat ring and said seat cover between generally horizontal positions on said flange and over center storage positions. In some embodiments, the distal end includes a flared blade of said elongate post. In some embodiments, said elongate posts are secured to each of said post holders via a threaded end of each of said elongate posts and a threaded recessed area in each of said post holders.

In another aspect, a toilet mounting hinge includes post holders; an elongate post secured to and extending downwardly from each of said post holders; a post receptacle; and, said elongate posts passing through and beyond said post receptacles and configured to permit a seat to be slidably elevated above a toilet bowl a maintenance position, and having a distal end configured to engage the receptacle in the maintenance position and to releasably support the elongate post in said position for cleaning and maintenance; where each of said post receptacles includes a receptacle head, a threaded sleeve, and an insert liner. In some embodiments, the threaded sleeve is a threaded metal sleeve. In some embodiments, the receptacle head includes a recessed area, and the post receptacle further includes a nut configured to screw onto the threaded metal sleeve, and to be received by the recessed area of the receptacle head. In some embodiments, the receptacle head, the insert liner, and the threaded metal sleeve are separate parts. In some embodiments, the insert liner includes a hollow shaft having a first end having a proximal shoulder and a second end having a distal shoulder. In some embodiments, the insert liner includes: a hollow shaft having a first end and a second end, and a crush cut-out. In some embodiments, the insert liner includes a flexible distal end; the threaded metal sleeve includes a proximal end, a distal end, and a hollow shaft; the receptacle head and insert liner are unitary; the receptacle head engages the proximal end of the threaded metal sleeve and the insert liner engages the hollow shaft of the threaded metal sleeve; and the distal end of the insert liner does not extend to the distal end of the metal sleeve.

BRIEF DESCRIPTION OF THE DRAWINGS

FIG. 3 is a fragmentary view in section of one mounting configuration of the invention with the post cast in a post holder and slidable in a receptacle with retainer.

FIG. 4 is a view in section of the mounting configuration taken on the line 4-4 of FIG. 3.

FIG. 5 is an enlarged view in section of a portion of FIG. 4 as there circled and labeled "FIG. 5".

FIG. 6 is a partial view of an alternate interface between the post holder and the receptacle head of FIG. 3.

FIG. 7 is a fragmentary view partially in section illustrating a mounting configuration similar to that of FIG. 9.

FIG. 7A is a partial view of the flared distal blade of a post, a receptacle and a retainer in section illustrating the interaction of the post and receptacle of FIG. 7 when in the maintenance position and taken along the plane 7A-7A.

FIG. 7B is a view in section of the interaction of the receptacle and flared distal blade of a post taken as indicated by the arrows 7B-7B of FIG. 7.

DETAILED DESCRIPTION

Figure 1:
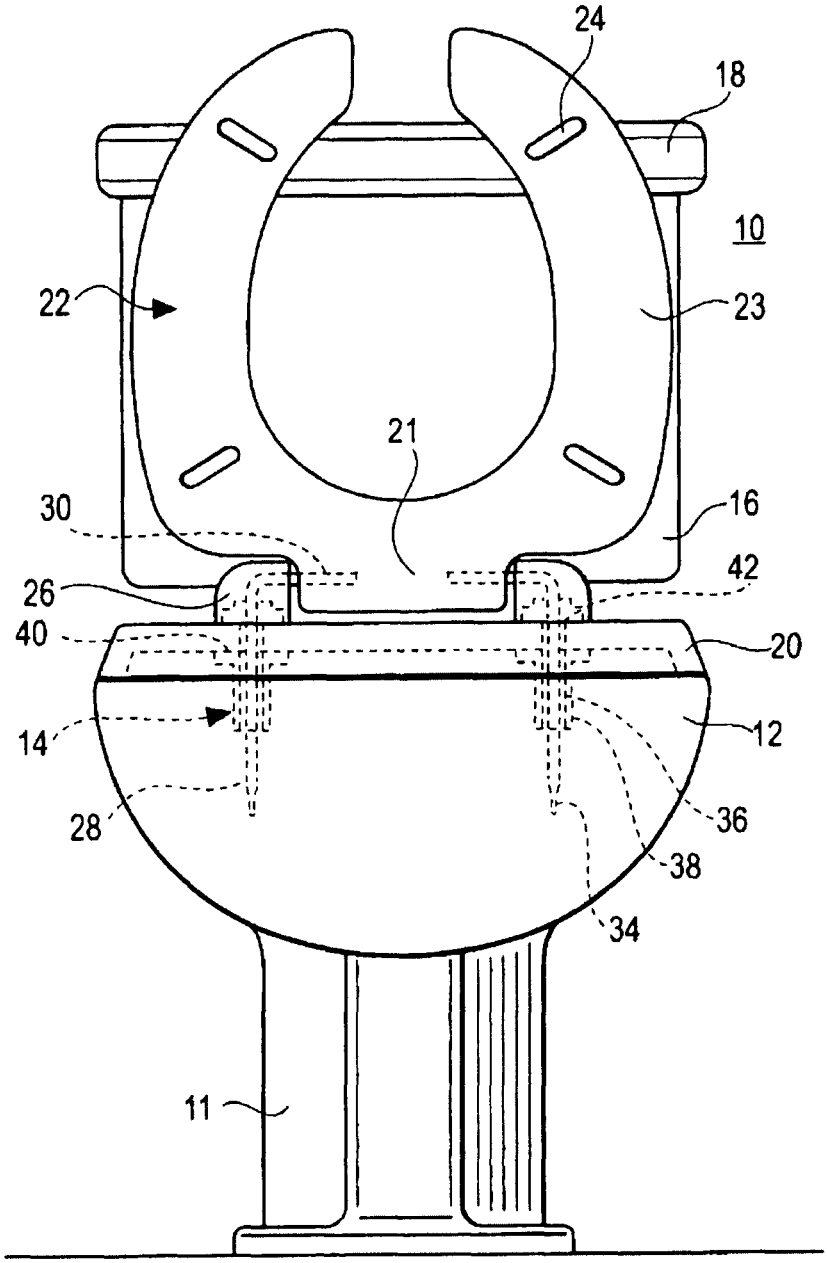
FIG. 1 is a front elevation of a toilet and conventional commercial style toilet seat shown in the conventional over center storage position and with parts of the mounting system of the invention shown in broken lines.

The invention disclosed herein is set forth in the following description, is illustrated in the attached drawings and is the subject of the attached claims. The embodiments of the invention shown and described hereinafter are examples that further illustrate the invention but should not be construed as in any way limiting the scope of the claims. For example, specific configurations are illustrated in the drawings for mounting the seat ring but the mounting means can vary widely within the scope of this invention.

Figure 2:
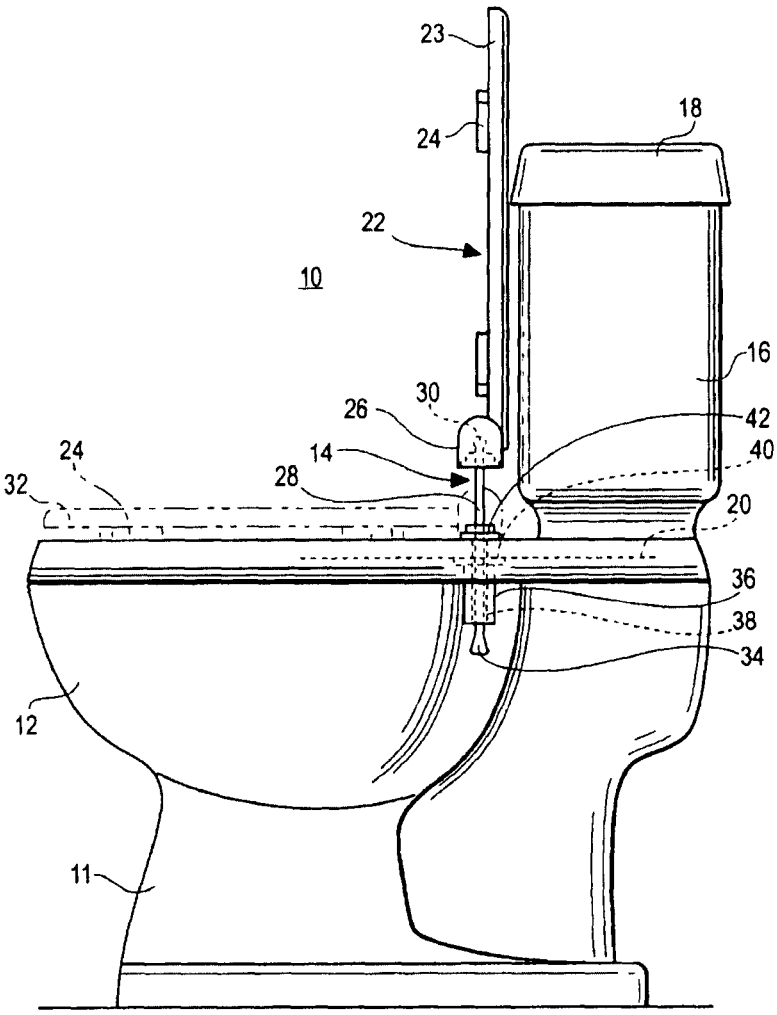
FIG. 2 is a side elevation of the embodiment of FIG. 1 showing the seat in the unconventional over center maintenance position for cleaning and maintenance and with the seat also shown in the conventional use position, but in broken lines.

Referring to the drawings and particularly to FIGS. 1 and 2, a typical commercial toilet 10 is shown having a toilet bowl 12 on a base 11 with a water tank 16 and a tank cover 18. A seat 22 can assume three distinct positions relative to the bowl. The bowl 12 has a bowl flange 20 with apertures 40 and a mounting system secured in the apertures 40 which supports the seat 22. The seat 22 is shown: in the over center storage position on the bowl flange 20 (solid line in FIG. 1); in the use position on bowl flange 20 (broken lines in FIG. 2); and, in the over center raised maintenance position above the bowl flange (solid lines in FIG. 2).

A unique post guidance apparatus 14 supports and facilitates the positioning of the seat 22. As shown in solid lines in FIG. 1, post holders 26 are resting on bowl flange 20 and are connected to seat mount 21 by a hinge pin 30 to support seat ring 23 in the over center storage position. As shown in solid lines in FIG. 2, the post holders 26 carrying the seat ring 23 are supported in an elevated over center maintenance position on elongate posts 28 for cleaning and maintenance in accordance with this invention. The post holders 26 and seat 22 are supported in the elevated maintenance position by interaction of the flared distal blades 34 of the posts 28 wedging into the distal portion of the post receptacles 36. Each receptacle 36 has a head 42 that engages the upper surface of bowl flange 20 and a body with external threads that extends through the bowl apertures 40 and substantially beyond the bowl flange 20. A cylindrical retainer 38 engages the underside of the bowl flange and is internally threaded to engage the externally threaded receptacle body 36 to reinforce and rigidly secure the receptacle 36 in place.

In the embodiment shown in FIGS. 1 and 2, the two post holders 26 with hinge pins 30 support the seat 22 for rotation between the over center storage position shown in solid lines in FIG. 1 and the use position of the seat indicated by broken lines 32 in FIG. 2. The seat 22 is lowered from the maintenance position of FIG. 2 to the storage position shown in solid lines in FIG. 1 by applying downward pressure on the seat to release the flared distal blades 34 of the posts from the receptacles 36. The seat 22 is then lowered so that the post holders 26 rest on the bowl flange 20 and enclose the receptacle heads 42. Post holder pockets within the post holders 26 engage the receptacle heads 42 for increased stability in the non-maintenance positions and to facilitate assembly of the system on the toilet flange 20. The seat is raised to the maintenance position by lifting the seat to engage the flared distal blades 34 of the posts 28 with the receptacles 36 with sufficient force to wedge the blades 34 into the receptacles 36 and maintain the seat in the elevated position as will be explained in greater detail hereinafter.

Figure 8:
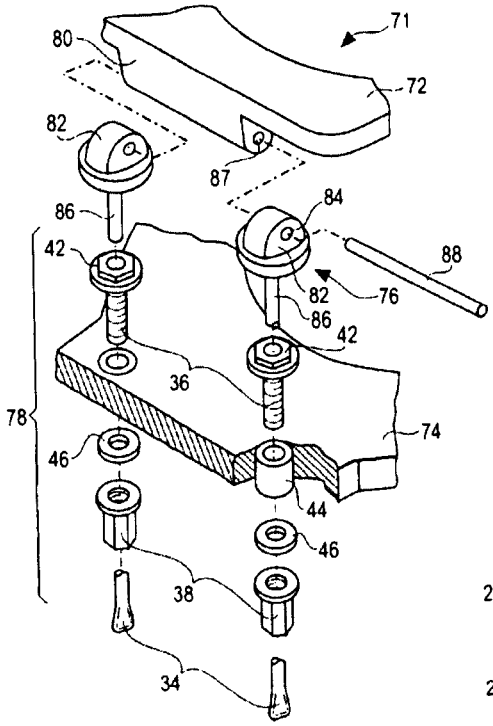
FIG. 8 is a fragmentary exploded view of one commercial style embodiment of the invention with two post holders.
Figure 9:
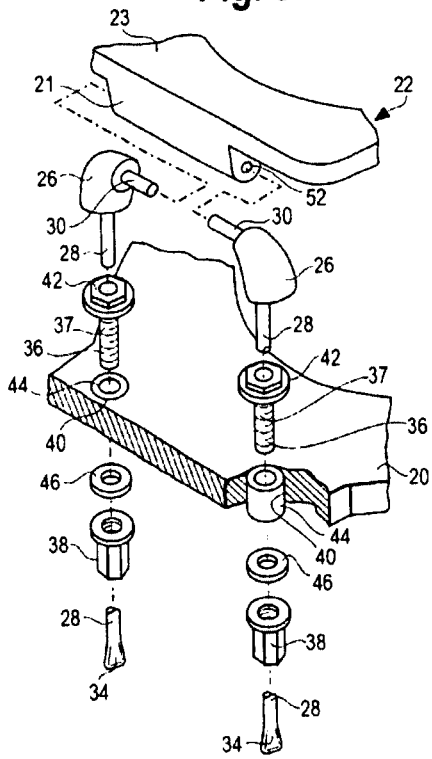
FIG. 9 is a fragmentary exploded view of a second commercial style embodiment of the invention with two post holders.

Application of this invention in various toilet seat and cover configurations can be seen in the illustrations of seat and bowl flange fragments and mounting apparatus in FIGS. 8-16. Referring specifically to FIG. 9, an exploded view of the commercial seat mounting system of FIGS. 1 and 2 is shown in relationship to toilet seat 22 including a bowl flange fragment 20 and a fragment of seat ring 23 and seat mount 21. Post holders 26 have subtending posts 28 (shown broken off) and generally horizontal hinge pins 30. As indicated by broken lines, the hinge pins 30 are longitudinally aligned and received in longitudinal apertures 52 in the seat mount 21. The hinge pins 30 supported in and extending from post holders 26 and disposed in apertures 52 in the seat mount 21 act as a hinge and comprise the seat mounting portion of this embodiment. Pin 30 and post 28 can be separate components or integrally formed as shown in FIG. 1 and explained with respect to FIG. 7, below.

Receptacles 36 are inserted in toilet bowl flange apertures 40 whereby receptacle heads 42 engage the upper surface of bowl flange 20 and the receptacles 36 extend through and beyond the bowl flange 20 an appropriate distance. The receptacles 36 are threaded over most of their length. The receptacles 36 have a short unthreaded length 37 immediately below the receptacle heads 42 with a reduced diameter to receive a compressible bushing 44 as will be explained in greater detail with respect to FIG. 3. An optional compression washer 46 is placed on each receptacle 36 from below followed by a threaded retainer 38 which is secured against the underside of the bowl flange 20. The retainers 38 reinforce the receptacles 36 and bushings 44 to provide a secure and rigid receptacle assembly and mounting system. The posts 28 have a sliding fit within the receptacles 36 and have sufficient length to permit the seat 22 to assume a position substantially above the bowl flange 20 to facilitate maintenance. The distal blades 34 of the posts 28 are formed to engage the reinforced receptacles 36 and maintain the seat in the elevated maintenance position. In the preferred embodiments, the distal blades 34 of posts 28 are progressively flattened and spread by swaging to form wedges or blades. In raising the seat 22 to the maintenance position, the flared distal blades 34 engage and slightly distort the receptacles 36, reinforced by the retainers 38. This engagement releasably holds the post 28 and seat 22 in the elevated maintenance position shown in FIG. 2.

This structure and the interface of the receptacles 36 and distal post ends can vary widely. In an alternative post distal end treatment, a small section of heat shrink tubing is applied to the bottom of the sliding post and the tubing engages a flared interior wall section at the bottom of the receptacle, creating a releasable friction fit. In another distal post end arrangement, the retainer defines a socket to accept the distal post end. The post end may be threaded to receive a threaded end plug tapered to engage the internal retainer wall. The tapered end plug is configured to fit into the retainer socket creating a releasable fit. Other receptacle to distal post end interfaces are disclosed and described in Utility patent application Ser. No. 11/581,900, and that disclosure is incorporated herein by reference.

FIG. 7 shows a cut away portion of one post and receptacle assembly shown in an extended maintenance position. The partially sectional view of post holder 26 shows the post 28 and the hinge pin 30 integrally formed at a right angle and cast within the post holder 26. This is a convenient, though not a required configuration. A portion of seat mount 21 is shown pivotally mounted on the hinge pin 30. Receptacle 36 extends through an aperture 40 in bowl flange 20 and is supported thereon by receptacle head 42. Retainer 38 is threaded onto receptacle 36 and has a flange 64 which clamps the retainer 38 through an optional compression washer 46 rigidly in place against the underside of bowl flange 20. Bushing 44 is compressed in aperture 40 to stabilize the entire system. The distal flare 34 of post 28 is forced into engagement with the receptacle 36 whereby the seat is releasably maintained in the extended maintenance position.

FIG. 7A is a view from the direction 7A-7A shown in FIG. 7. FIG. 7A shows the relationship of the flattened and flared distal blade 34 of post 28 wedged into receptacle 36. The receptacle 36 has relatively thin walls to pass through the bowl flange apertures 40. Thus, radial pressure of the distal blade 34, if unrestrained, could produce excessive radial distortion of the relatively thin walled receptacle 36. That distortion is controlled by the more rigid retainer 38. FIG. 7B is taken on the line 7B-7B in FIG. 7 and shows the engagement of the flared distal blade 34 of the post with the receptacle 36. However, distortion of the receptacle 36 is barely perceptible when supported by the retainer 38 which can have greater wall thickness.

A right sectional view of a portion of the seat mounting apparatus associated with one aperture 40 of the bowl flange 20 is shown in FIG. 3. Post receptacle 36 extends through the aperture 40 and is supported by receptacle head 42. Post holder 26 supports post 28 which passes through and beyond receptacle 36. The length of the post 28 establishes the desired spacing of the seat 22 above the bowl flange 20 when the seat is in the extended, maintenance position. Receptacle 36 is threaded over most of its length but has unthreaded portion 37 of smaller outside diameter to define a cylindrical cavity within aperture 40. Bushing 44 occupies that cavity. Because bowl apertures 40 can vary in diameter, the bushing 44 is of a somewhat compressible, stretchable polymer such as polyurethane and is configured to fit tightly in the aperture 40 and expand under longitudinal compression to radially fill the cavity and stabilize the seat against lateral movement. Retainer 38 has internal threads over all or most of its length and is coextensive with or slightly shorter than the receptacle upon assembly. It is drawn up tightly against the bowl flange 20 through an optional compression washer 46. Post holder 26 is shown supported on the bowl flange 20 in the use or storage position with a post holder pocket 41 to accommodate the receptacle head 42. The rod that comprises the post has a right hand bend as shown at 54 to form a hinge pin as shown in FIG. 7. The distal blade 34 of post 28 is swaged to provide a flattened tapered blade configuration to engage the receptacle 36 when elevated. An optional set screw 66 fastened in aperture 68 may be provided to insure against any rotation of the retainer 38 relative to receptacle 36 assuring a stay-tight assembly.

FIG. 4 is a sectional view taken on the line 4-4 of FIG. 3 and illustrates a small clearance 56 provided between the inner diameter of receptacle 36 and the metal post 28. This clearance is the result of draft in the internal diameter of the molded polymer receptacle 36 to facilitate removal of a core pin from the receptacle in the molding process. Crush ribs 58, shown exaggerated in FIG. 5, are molded on the inside wall of the receptacle 36 to counteract the effect of draft in the bore of receptacle 36.

Receptacle head 42 can have several configurations. In FIG. 7, the receptacle head 42 has a round lower portion 39 to receive round recess 48 in post holder 26 and a hex crest 43 to facilitate installation of the assembly. The hex crest 43 interfaces with a hex or ribbed cavity 41 in the post holder 26 when the post holder 26 is in the lowered position. This interface of hex crest 43 in cavity 41 locks the receptacle 36 against rotation when installing the retainer 38. This interface also assists in maintaining the post holder 26 in place when in the non-maintenance positions as shown in FIG. 3. FIG. 6 illustrates an alternate example of configurations where the post holder 60 has a square cavity or post holder pocket 62 and the receptacle head 63 has a corresponding square shape 65 with a bevel 70 to facilitate closure alignment of the post holder on the flange.

FIG. 8 is an exploded fragmentary view of another commercial embodiment of the invention showing a seat 71 having a seat ring 72, and seat mount 80. The seat 71 of FIG. 8 includes a seat mount 80 having a longitudinal aperture 87, post holders 82 having apertures 84 extending there through and aligned with aperture 87, posts 86 extending downwardly from the post holders 82, and receptacle assemblies 78. Receptacle assembly 78 comprises the bushing 44, receptacles 36 with heads 42, retainers 38 and optional washers 46. A hinge pin 88 passes through the post holder apertures 84 and the seat aperture 87. The hinge pin 88 may have a drive fit through the seat mount 80 or in one or both of the post holders 82. In the alternative, the pin or pins may be appropriately cemented or over-molded in place in the seat mount 80 prior to insertion into the post holders 82. The flared distal blades 34 of posts 86 cooperate with the inner surface of the receptacles 36 in the manner already described.

Figure 10:
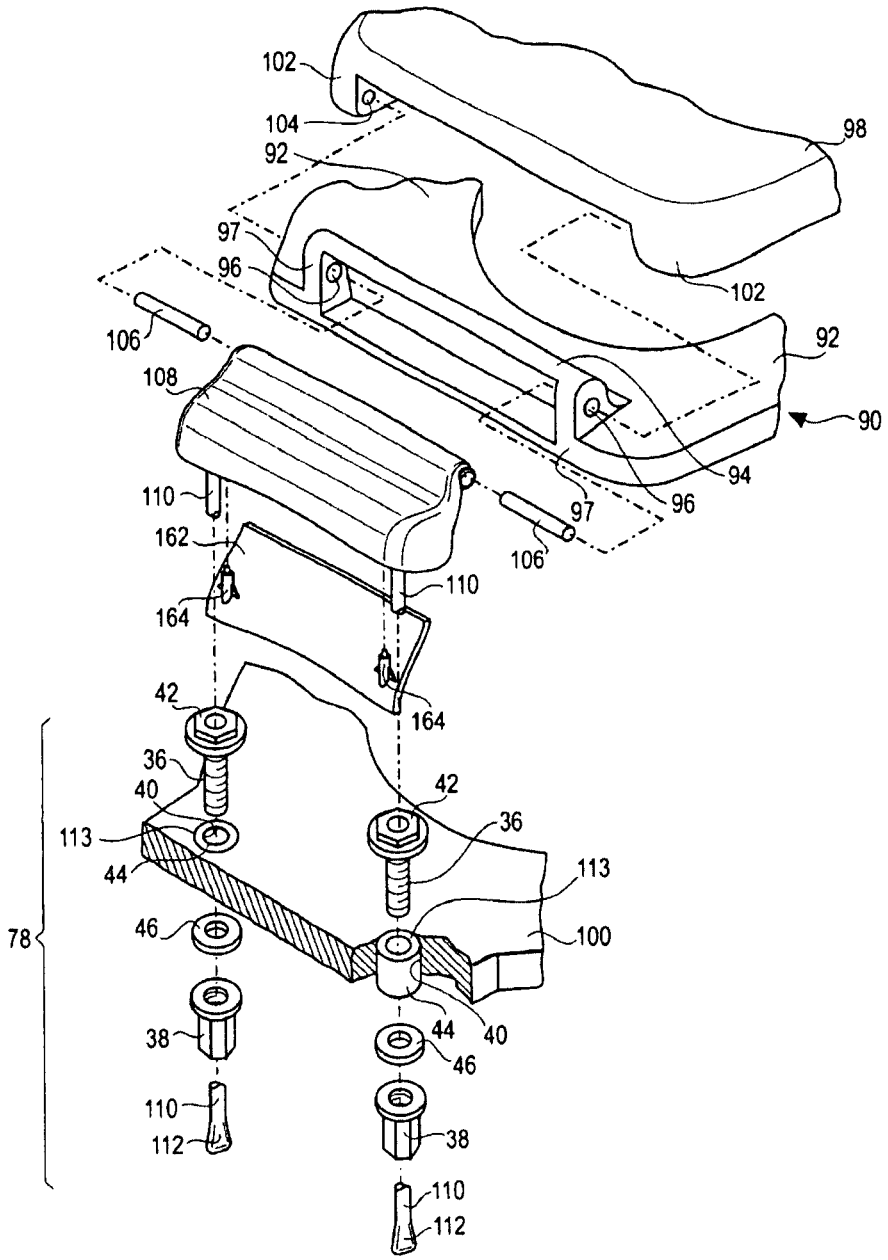
FIG. 10 is a fragmentary exploded view of one residential style embodiment of the invention with a double post holder.

FIG. 10 is an exploded fragmentary view of a residential embodiment of the invention that has a seat 90 and a seat cover 98 independently mounted for pivotal support on a toilet bowl flange 100. The seat comprises a seat ring 92 and seat mount 94. The seat mount 94 includes supporting trunnions 97 which extend transversely above the rear edge of the seat ring 92. The trunnions 97 have aligned apertures 96 to receive hinge pins 106. The seat cover 98 is mounted above the seat 90 and has a mount 102 with apertures 104 to receive hinge pins 106.

A double post holder 108 supports two parallel posts 110 spaced to fit the apertures 113 in the bowl flange 100. The posts 110 are longitudinally slidable in the receptacles 36 between a use or storage position and maintenance position as previously described in detail with respect to FIG. 3. A shield 162 may be secured to the underside of the double post holder 108 for aesthetic enhancement and to avoid any contamination or accumulation of debris beneath the post holder. The shield 162 is secured under the double post holder 108 with interfit edges and two mounting pins 164 that engage sockets in the underside of the double post holder 108. The flange mounted receptacle assembly 78 is described in detail with respect to FIG. 8. General details of the double post holder 108, the shield 162 and the mounting pins 164 as shown in FIG. 10 are further shown in and described with respect to FIGS. 11A and 12-14.

Figure 11:
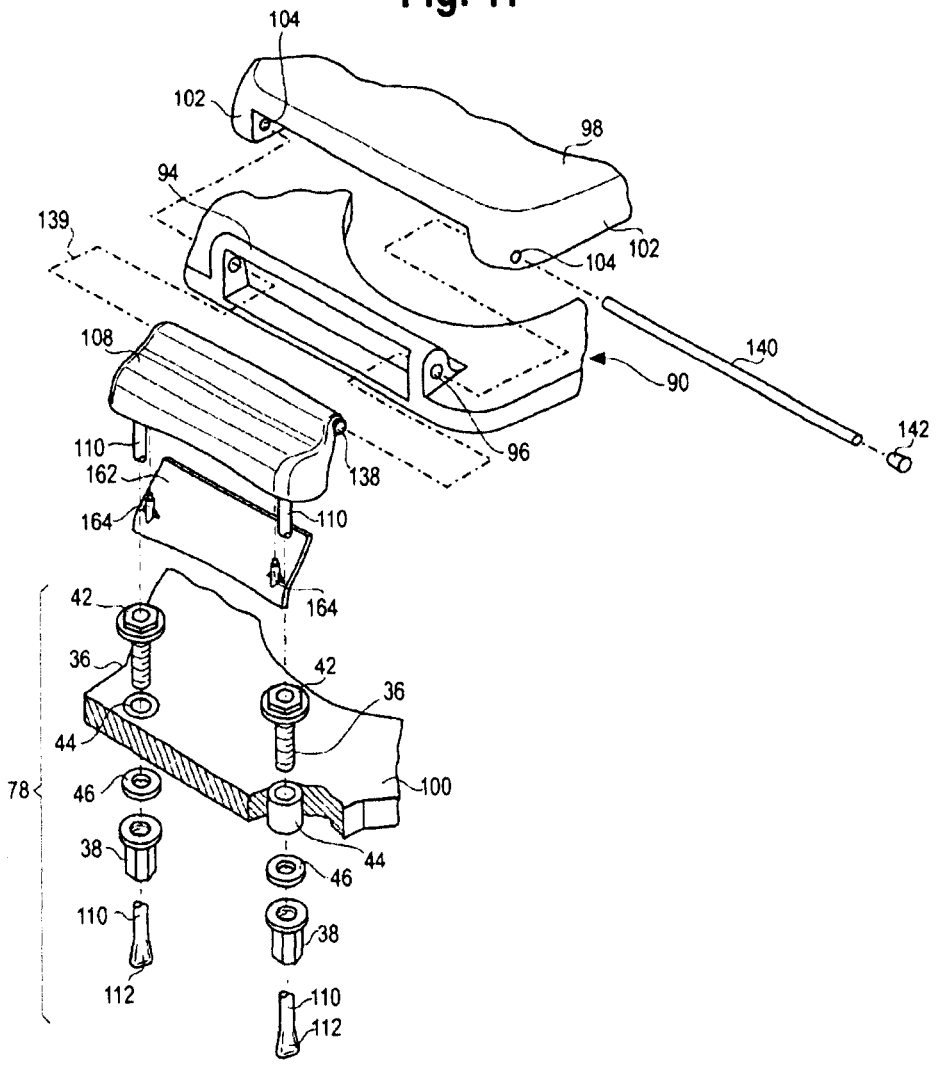
FIG. 11 is a fragmentary exploded view of a second residential style embodiment of the invention incorporating a double post holder.
Figure 11A:
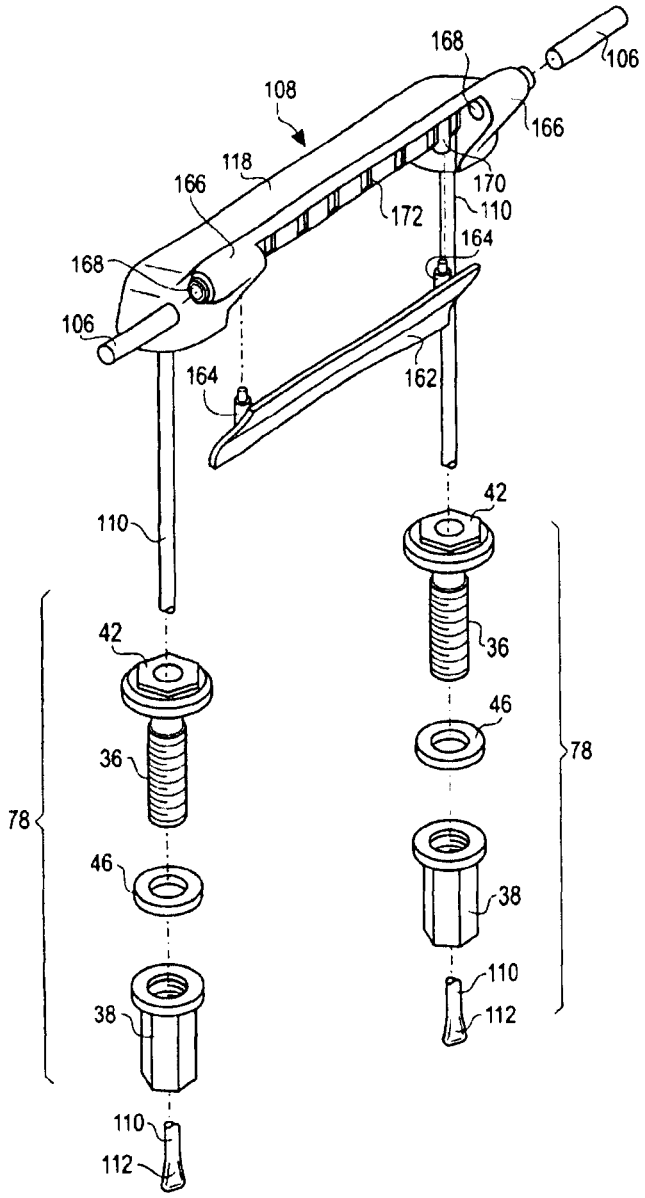
FIG. 11A is an exploded perspective view of the double post holder shown in respect to FIG. 11.

An exploded view of the double post holder 108 and shield 162 appears in FIG. 11A. The double post holder 108 is configured with post holders to support two posts 110 spaced apart and extending from the double post holder central body 118 for accommodation in toilet bowl apertures having standard industry spacing as already described. The posts 110 have distal interference means 112, i.e., a distal end. The double post holder 108 also has a trunnion portion 166 associated with each post 110. Each trunnion 166 defines a hinge aperture 168. The apertures 168 are aligned to receive respective hinge pins 106 which pivotally support the seat and cover for rotation as previously described. The shield 162, configured to enclose the central body 118 of double post holder 108, has two mounting pins 164. The double post holder 108 has two pin sockets 170 spaced to accommodate the shield mounting pins 164 and internally configured to receive and retain the pins 164 upon insertion, thus securing the shield in position. The underside of the central body 118 of double post holder 108 has a ribbed configuration 172 to provide enhanced strength using minimum material. For ease of consumer assembly and to accommodate for the configuration of flared distal blades 112, the receptacles 36 can be mounted on the posts 110 and secured in place by the interference means 112 at the time of manufacture. As best understood from FIG. 10, to install the seat or the seat and cover system on the toilet flange for typical consumer use, the installer: installs bushings 44 onto receptacles 36; inserts the posts with preassembled receptacles 36 through the bowl flange apertures; may place the optional washers 46 onto the receptacles 36; threads the retainers 38 unto the receptacles 36; and tightly secures the receptacles 36 against the bowl flange 100 for rigid positioning.

Figure 12:
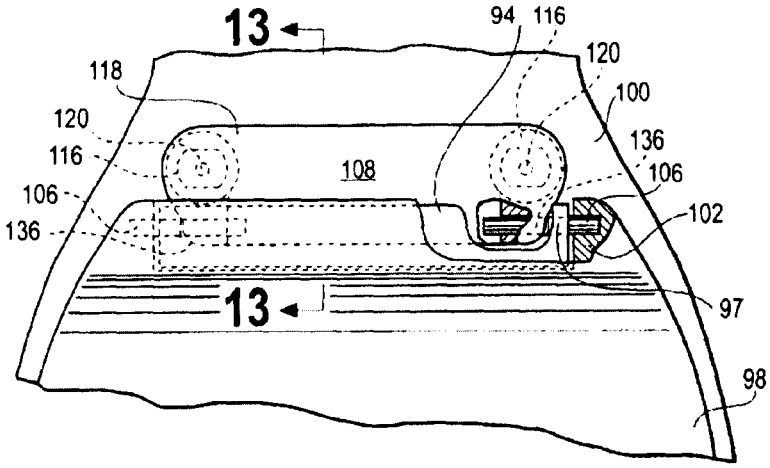
FIG. 12 is a fragmentary top view of a residential style embodiment of the invention incorporating a double post holder and showing details of a portion of the mounting apparatus in broken lines.
Figure 13:
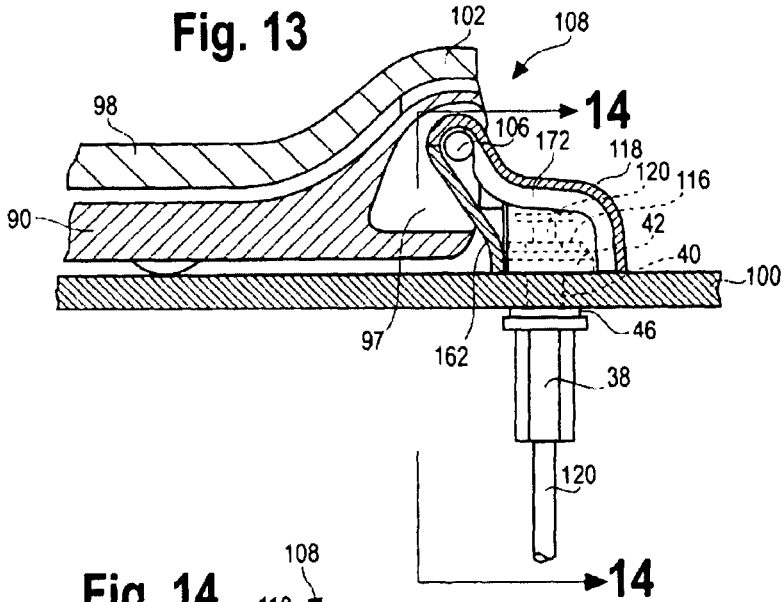
FIG. 13 is a view in section of a fragmentary showing of details of the mounting apparatus taken on the line 13-13 of FIG. 12.

A broken away view of the double post holder 108, the seat mount 94 and the seat cover 98 of FIG. 10 are shown in FIGS. 12 and 13. Double post holder 108 is shown resting on the flange 100 and includes two post holders 116 disposed in a central body 118. Posts 120 are cast in and extend downwardly from the post holders 116. In FIG. 12, the central body 118, one post holder 116, the seat mount 94 and the cover mount 102 are shown partially broken away. Each post holder 116 has a cantilevered arm 136 which supports a hinge pin 106. Seat trunnions 97 of seat mount 94 and cover mount 102 are pivotally mounted on hinge pin 106 for rotating the seat 90 and cover 98 between the use and the storage positions.

FIG. 13 is a fragmentary sectional view taken on line 13-13 of FIG. 12 and shows a fragment of bowl flange 100 supporting the seat 90 and the seat cover 98 pivotally mounted on double post holder 108. Seat mount 97 of seat 90 and cover mount 102 of seat cover 98 are mounted on and supported for rotation on hinge pin 106. Shield 162 is secured to the double post holder 108 to cooperate with central body 118 to cover and isolate the space between the post holders 116 and thereby minimize contamination and accumulation of residue in this area. The central body portion 118 has strengthening ribs 172. A post 120 is molded into each post holder 116 and extends through the head 42 of receptacle 36. The head 42 and receptacle 36 are secured in place by optional washer 46 and retainer 38 as described in detail with respect to FIG. 10.

Figure 14:
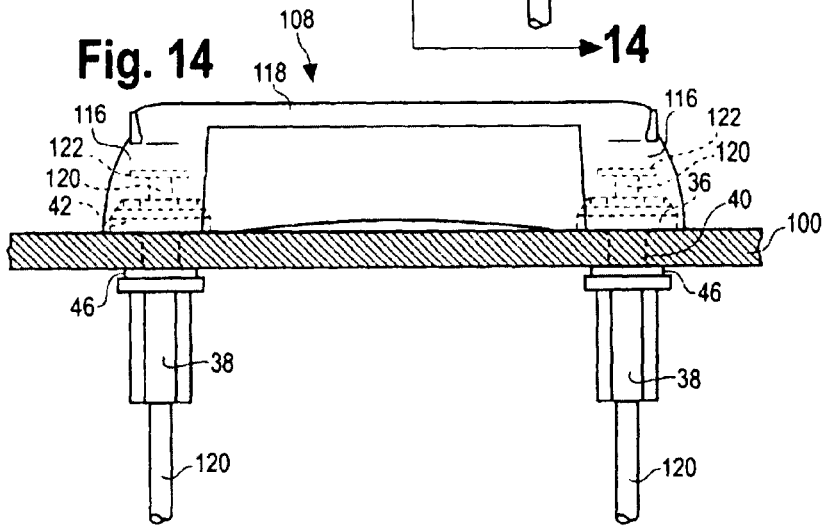
FIG. 14 is a front elevation showing details of the double post holder of FIG. 12.

The front view of FIG. 14 further illustrates the configuration and internal construction of the double post holder 108. The double post holder 108 includes two post holders 116 and a central body portion 118. The central body portion 118 has ribs seen in FIGS. 11A and 13 which are omitted in this view. A post 120 with a post head 122 is cast within each post holder 116 and is shown in broken lines. The posts 120 extend downwardly from the double post holder 108 and have a length appropriate for accommodating extension that raises the seat and cover for cleaning and maintenance.

FIG. 11 is a fragmentary exploded view of another embodiment of the invention similar to the embodiment of FIG. 10. The receptacle assembly 78 is secured to the bowl flange 100 as previously described. The double post holder 108 supports posts 110 which extend through the apertures in the receptacles and have swaged distal blades 112 shaped to enable the flared distal blades to engage the receptacle and support the seat and cover in the extended maintenance position also as previously described. The double post holder 108 is constructed as shown in FIGS. 11A, 13 and 14 with an aperture 138 to accommodate a hinge pin 140. Seat 90 has a mount 94 with apertures 96 and cover 98 has a mount 102 with apertures 104. Seat apertures 96 and seat cover apertures 104 are assembled in alignment with double post holder aperture 138 as indicated by the broken line 139 to receive hinge pin 140. In this embodiment, the hinge pin 140 when assembled extends through the apertures 104 in cover 98, apertures 96 in seat 90 and apertures 138 in the double post holder 108. The pin 140 has a press fit in the double post holder apertures 138 or in all of the apertures and is preferably shortened in length to accommodate a plug 142.

Figure 15:
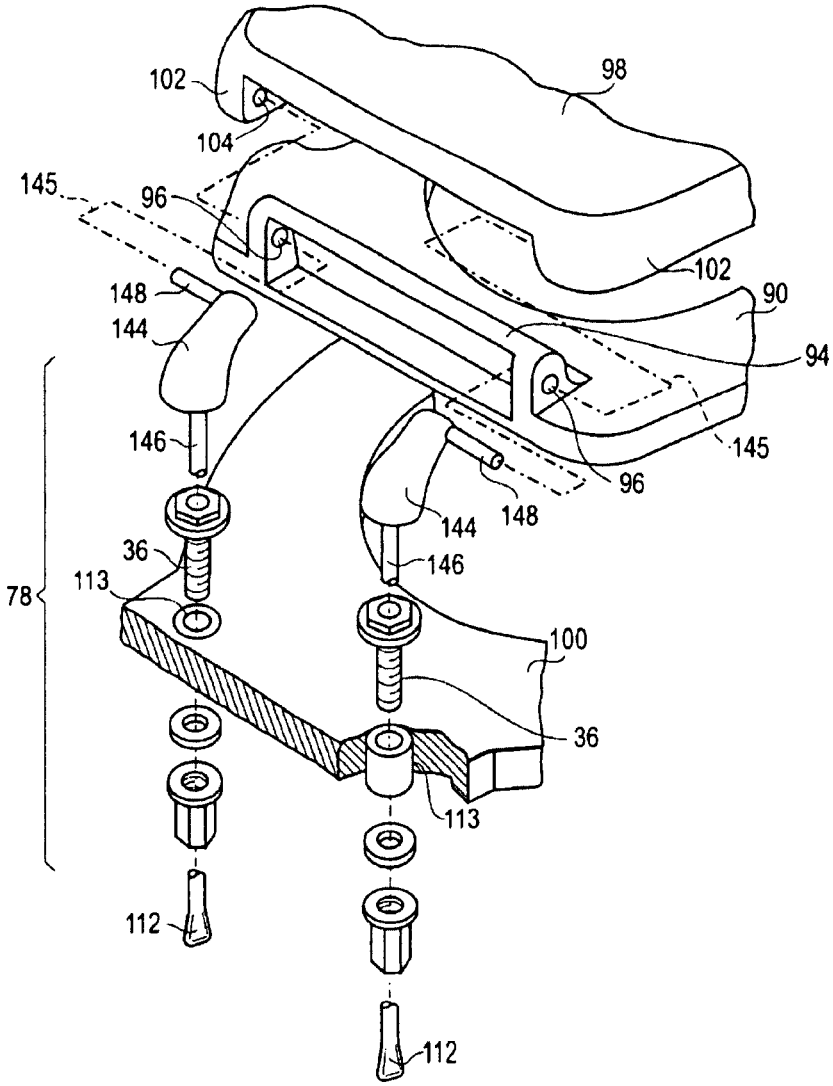
FIG. 15 is a fragmentary exploded view of a third residential embodiment of the invention with two post holders.

FIG. 15 is a fragmentary exploded view of another embodiment of the invention with a seat and cover arrangement similar to that of the embodiment of FIG. 10, but with two separate and independent post holders 144. The seat system is mounted on the toilet bowl flange 100 and includes a toilet seat 90 having seat mount 94 with apertures 96 and a seat cover 98 with mount 102 having apertures 104. The apertures 104 have a depth whereby they do not extend through the mount 102 and are not externally visible in the finished product. The system has receptacle mounting apparatus 78 mounted in the toilet bowl apertures 113 to support the seat 90 and seat cover 98. A post holder 144 is provided for each toilet bowl aperture 113 and each has a post 146 vertically disposed for a sliding fit in the respective receptacles 36 and a hinge pin 148. The post holder 144 can be configured to have the post 146 and hinge pin 148 formed as a single piece and molded in the post holder in the manner shown in FIG. 7. As an alternative posts 146 and hinge pin 148 can be formed separately and, using over-molded or casting techniques, cast into the post holder 144 to insure positive positioning and support. The hinge pins 148 are received in the respective seat apertures 96 and cover apertures 104 as indicated by broken lines 145 prior to insertion of the receptacles 36 in the bowl flange apertures 113.

Figure 16:
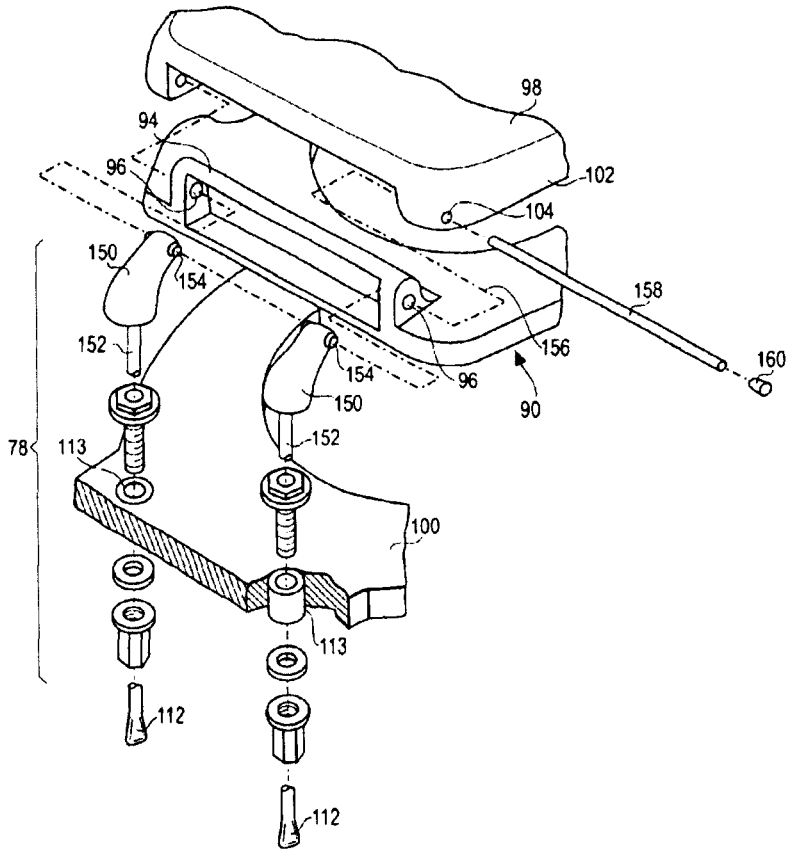
FIG. 16 is a fragmentary exploded view of a fourth residential embodiment of the invention with two post holders.

FIG. 16 is a fragmentary exploded view of another embodiment of the invention similar to FIG. 15 but utilizing a single hinge pin 158. The combination includes a toilet seat 90 having a seat mount 94 with apertures 96 and a seat cover 98 with mount 102 having apertures 104. The system has a receptacle assembly 78 mounted in the toilet bowl apertures 113 to support the seat 90 and seat cover 98. A post holder 150 is provided for each aperture 113. Each post holder 150 supports a post 152 and has an aperture 154 to receive a hinge pin 158. As described above, each post 152 is preferably molded in a polymer post holder 150 as is known in the art. The various components function together and are assembled for use as indicated by the broken line 156. A hinge pin 158 is then inserted through the apertures in cover 98, seat 90 and post holders 150. It is preferable to provide a drive fit between the pin 158 and all of the apertures. The length of pin 158 is selected to accommodate a cap 160 inserted in the end of each seat cover aperture 104.

Figure 17:
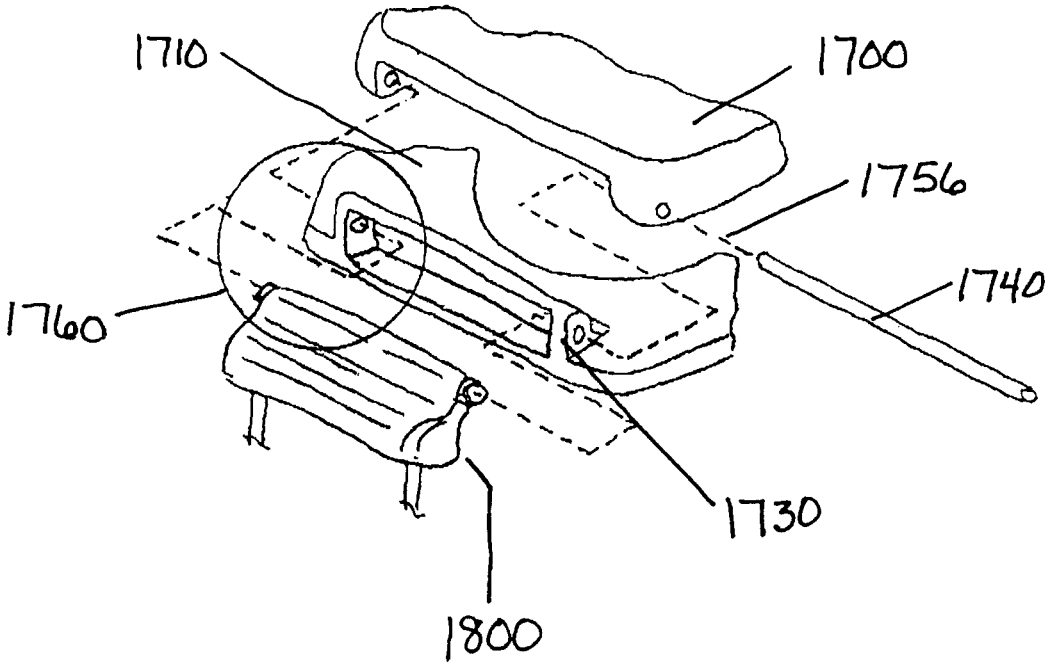
FIGS. 17 and 18 are complementary views of the rear projection of a toilet seat assembly including a seat cover, seat, seat mounting means, hinge shroud, and nest according to one embodiment.
Figure 18:
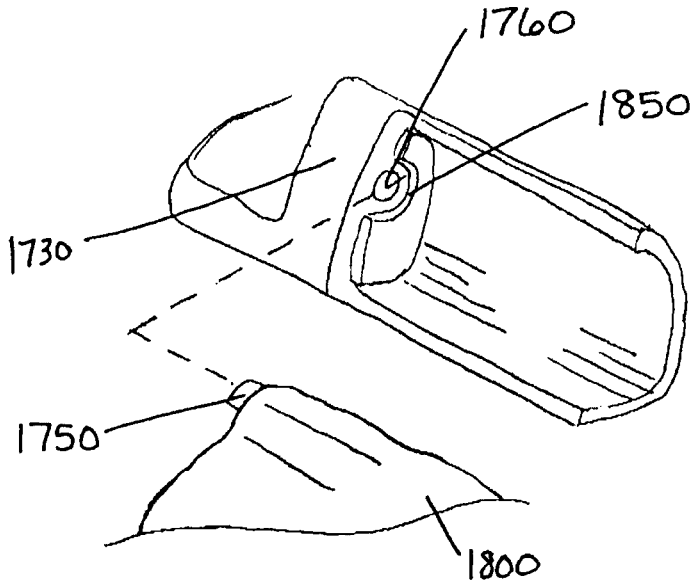

In some embodiments, hinge assemblies incorporate a nest 1850. FIGS. 17 and 18 are complementary views of the rear projection of a toilet seat assembly including a seat cover 1700, seat 1710, seat mount 1730, hinge shroud 1800, and nest 1850. FIG. 18 is an exploded view of the encircled portion 1760 of FIG. 17. The hinge shroud 1800, in some embodiments, incorporates a hinge shroud sleeve 1750 as a guide for the hinge pin 1740. The exploded view shown in FIG. 18, is a detail of the nest 1850 for receiving the hinge shroud sleeve 1750. The nest 1850 is a relief portion of the seat mount 1730, and is configured to center the hinge shroud sleeve 1750 with the pin receiving bore 1760. The nest 1850 is molded with and integral to the seat mount 1730. As shown in FIG. 17, the various components function together and are assembled for use as indicated by the broken line 1756.

Figure 19:
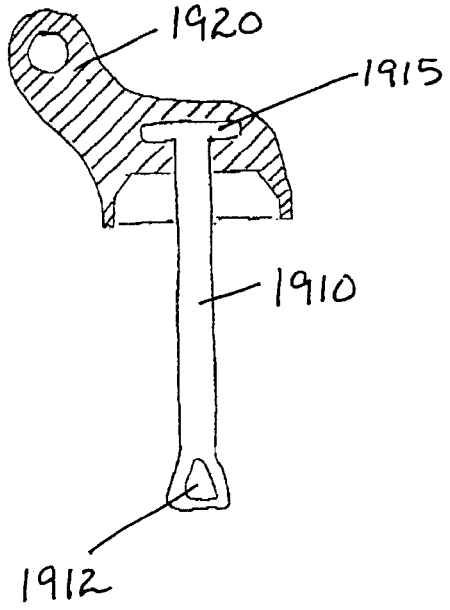
FIG. 19 is a cross-sectional view of a post that is overmolded in the post holder, according to one embodiment.
Figure 20:
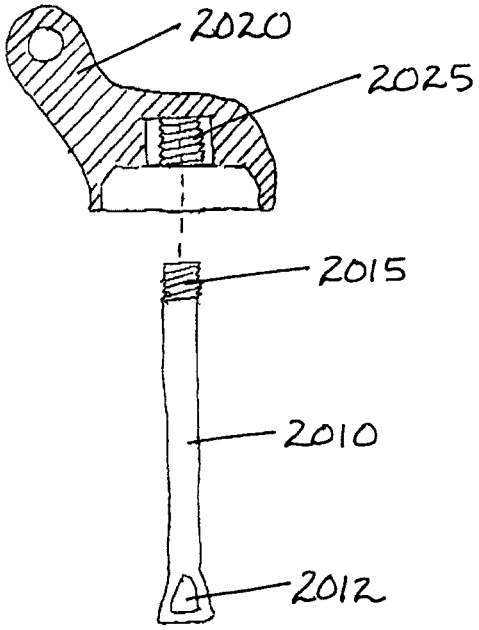
FIG. 20 is a cross-sectional view of a threaded post and threaded recessed area in a toilet seat hinge, according to one embodiment.

As illustrated and described above, posts 110, 120, 146, and 152 may be over-molded or cast in the post holders. FIGS. 19 and 20 are two further embodiments of securing posts 1910 and 2010 in post holders 1920 and 2020, respectively. As illustrated in FIG. 19, in one alternative, the post 1910 is over-molded in the post holder 1920 where the post 1910 has a head 1915 to provide a larger contact area with the material which forms the post holder 1920. As illustrated in FIG. 20, according to another alternative, the post 2010 has threading 2015 on one end, and the post holder 2020 has a threaded recessed area 2025. The threading 2015 of the post 2010 is then screwed into the threaded recessed area 2025 of the post holder 2020. Each of the posts 1910, 2010 may also have flared distal blades 1912, 2012, respectively, as described above in other embodiments.

Figure 21:
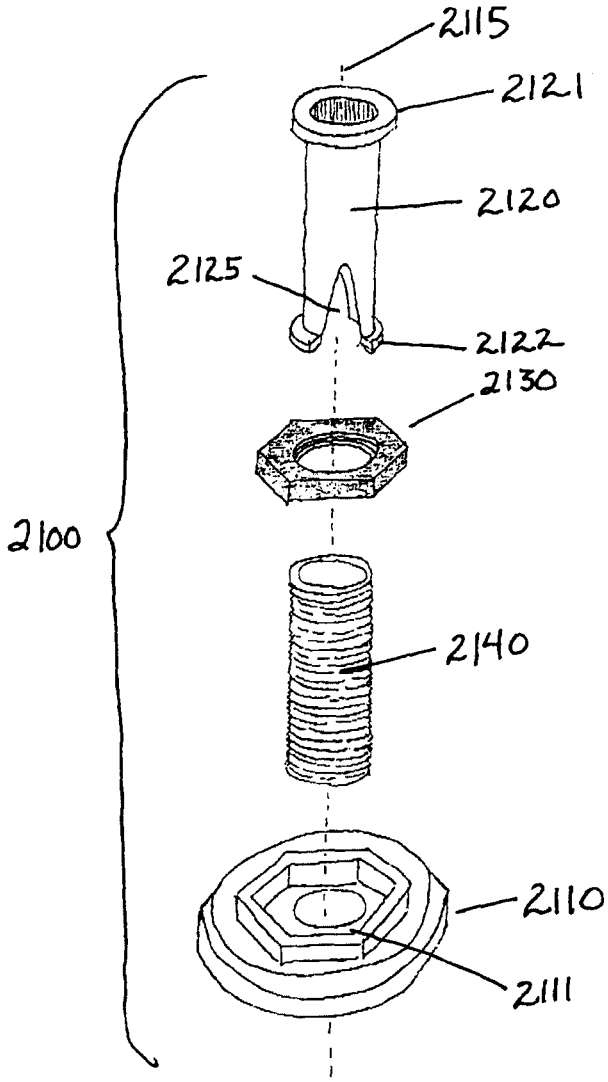
FIG. 21 is a fragmentary exploded view of one alternate embodiment of a post receptacle with a separate receptacle head.

FIG. 21 is a fragmentary exploded view of one embodiment of a post receptacle 2100. The post receptacle 2100 includes an insert liner 2120, a nut 2130, a threaded sleeve 2140, and a receptacle head 2110. The broken line 2115 indicates how the various components can be assembled. Such embodiments are configured to allow the post receptacle 2100 to be secured to a specified torque via a threaded receptacle retainer 2150 (not shown) such as described above as retainer 38, thereby securing a toilet seat assembly to a toilet.

Figure 22:
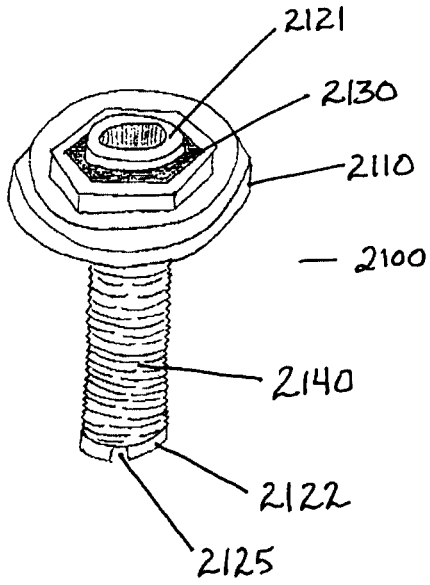
FIG. 22 is a perspective view of the one alternate embodiment of the post receptacle with the separate receptacle head shown in FIG. 21.

In one embodiment, the separate receptacle head 2110 is configured to allow the nut 2130 to have a secure fit inside a recessed area 2111 in the separate receptacle head 2110. The secure fit is intended to prevent the nut 2130 from turning during tightening of threaded receptacle retainer 2150. The secure fit can be achieved by having making the recessed area 2111 in the separate receptacle head 2110 of a shape that is complementary to that of the nut 2130. In some embodiments, the opening and the nut 2130 are oval, triangular, square, rectangular, pentagonal, hexagonal, star or other shapes as will be recognized by those of skill in the art. A hexagonal shape is shown in FIGS. 21 and 22.

The insert liner 2120 may take a variety of shapes and sizes, that may depend upon the design of the threaded sleeve 2140 and/or upon the size of the posts described above with regard to both length and diameter of the posts. For example, as shown in FIG. 21, the insert liner 2120 may be configured with a proximal shoulder 2121 and a distal shoulder 2122. The shoulders 2121, 2122 allow the insert liner 2120 to be secured within the threaded sleeve 2140. In addition, FIG. 21 shows an optional crush cut-out 2125, such that the crush cut-out allows for the insert liner 2120 to be compressed on one end and inserted into the threaded sleeve 2140, whereby it returns to an uncompressed state allowing the shoulder 2122 to secure the insert liner 2120 within the threaded sleeve 2140. As shown in FIG. 21, and also in FIGS. 22 and 23, crush cut-out 2125 is located near the distal shoulder 2122. However, it will be understood that in an alternative orientation, the insert liner 2120 may be inserted in the threaded sleeve 2140 such that the crush cut-out 2125 is located near the proximal shoulder 2121. Such alternative orientation provides a continuous surface at distal shoulder 2122.

Such a configuration for the post receptacle 2100 allows for the threaded sleeve 2140 to be constructed from a different material than the receptacle head 2110 and/or the insert liner 2120. For example, the threaded sleeve 2140 may be constructed from steel, stainless steel, or other metals, while the separate receptacle head 2110 and the insert liner 2120 may be prepared from a different metal or a plastic material. The configuration also permits the threaded sleeve 2140 to be made other materials, such as a high impact plastic, that are less susceptible to deformation under torque than if made of the same material used to construct or mold the receptacle head 2110 and/or insert liner 2120. For example, in all plastic systems, tightening of a receptacle retainer may cause distortion or deformation of a post receptacle at higher torques. By constructing the threaded sleeve, and optionally, the threaded receptacle retainer, from high impact plastic or metal, the post receptacle 2100 is able to withstand tightening of the apparatus to higher torques. Torques in excess of 50, 60, 70, or 80 or more in-lbs may be achieved without deformation or distortion of the post receptacle which could otherwise lead to binding of the posts.

In some embodiments, the insert liner 2120 is made of a material that allows for the flared distal blades 1912, 2012, to securely hold the seat in a raised position via an interference fit, as described above for other flared blades. The flared blades 1912, 2012 are configured to wedge into the insert liner 2120 near the distal shoulder 2122, in a manner as described above with regard to post receptacles 36.

FIG. 22 is a perspective view of the assembled post receptacle 2100 illustrated in the exploded view of FIG. 21. This perspective view shows the insert liner 2120, the nut 2130, the threaded sleeve 2140, and the separate receptacle head 2110 in an assembled fashion, with the nut 2130 secured within the complementary shaped recess 2111 of the receptacle head 2110. Additionally, FIG. 22 illustrates proximal shoulder 2121, and distal shoulder 2122 securely engaging the nut 2130 and threaded sleeve 2140, respectively. It should be noted that insert liner 2120 may optionally be inverted, whereas shoulder 2121 would be located at the bottom of the assembly and shoulder 2122 would be located at the top.

Figure 23:
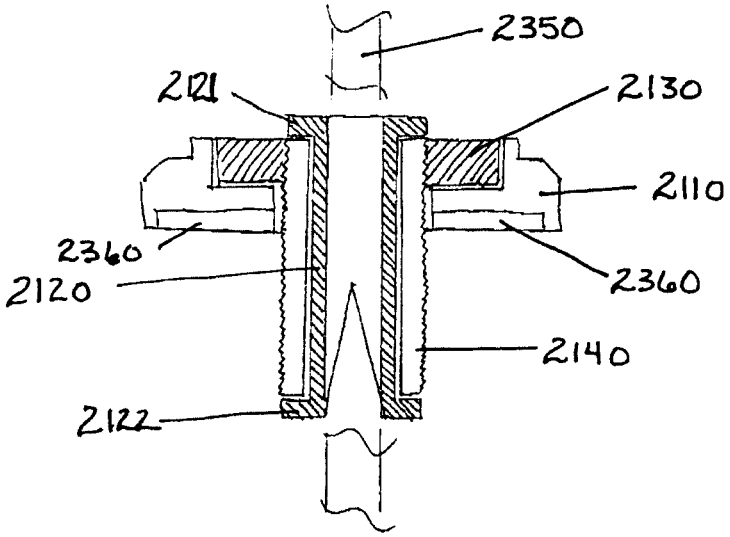
FIG. 23 is a fragmentary view in section of the one alternate embodiment of the post receptacle with the separate receptacle head shown in FIG. 21.

FIG. 23 is a cross-sectional view of the assembled post receptacle 2100 shown in FIG. 21. In addition to the assembled insert liner 2120, nut 2130, threaded sleeve 2140, and receptacle head 2110, a post 2350, and optional recessed area 2360 in the receptacle head 2110 are shown. The post 2350 is inserted through the combined post receptacle 2100 and separate receptacle head 2110 assembly as shown, and in the same fashion as the components described above. The optional recessed area 2360 is configured to receive a compression washer to assist in securing the complete assembly to the toilet, or to provide increased surface contact with the toilet in the case where the toilet has uneven mounting surfaces.

Figure 24:
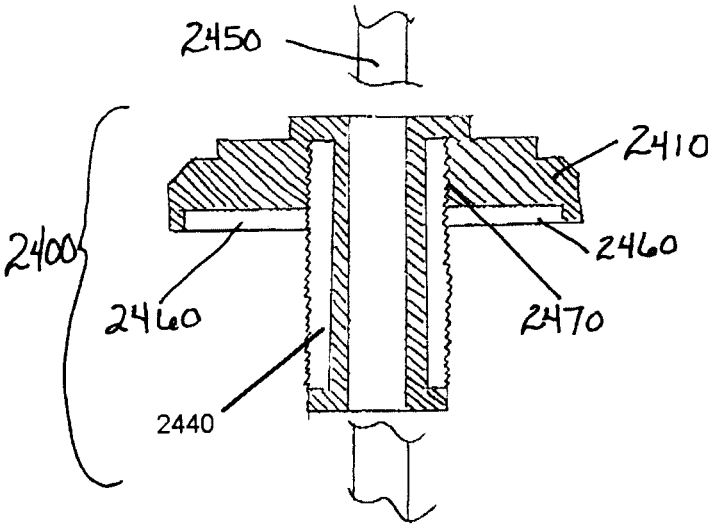
FIG. 24 is a fragmentary view in section of another alternate embodiment of a post receptacle with a receptacle head.

FIG. 24 is a cross-sectional view of a post receptacle 2400 with a unitary receptacle head and insert liner 2410, according to one embodiment. In such embodiments, the unitary receptacle head and insert liner 2410 is engaged within a threaded sleeve 2440. The unitary receptacle head and insert liner 2410 may be prepared by over-molding a polymer directly onto the threaded sleeve 2440, or onto the threaded sleeve 2440 and a nut (not shown), thereby reducing the number of parts that would require assembly. The threaded sleeve 2440 may be made of a variety of materials such as polymer or metal. The unitary receptacle head and insert liner 2410 may include a recessed area 2460 for receiving a compression washer.

The unitary receptacle head and insert liner 2410 may also be formed without over-molding of the threaded sleeve 2440. For example, the unitary receptacle head and insert liner 2410 may be molded and a threaded recess 2470 may be tapped or molded into the unitary piece 2410. As described above for post receptacle 2100, the insert liner portion of the unitary receptacle head and insert liner 2410 may also include a crush cut-out similar to that of crush cut-out 2125 in FIG. 21, for insertion into the threaded sleeve 2440.

The unitary receptacle head and insert liner 2400 may eliminate the need for a nut as used for post receptacle 2100. As such, a threaded recessed region 2470 may be tapped or molded into the unitary receptacle head and insert liner 2400. The threaded sleeve 2440 may then be secured and tightened in the threaded recessed region 2470. Alternatively, a nut (not shown) may be used in conjunction with the unitary receptacle head and insert liner 2400, with the unitary part 2400 molded over the nut and threaded sleeve 2440. Also as shown in FIG. 23, a post 2350 may be inserted through the unitary receptacle head and insert liner 2400.

As above, such a configuration allows for the receptacle head and insert liners, e.g., 2400, and the threaded sleeve, e.g., 2440, to be constructed from different materials. For example, the threaded sleeve may be a threaded metal sleeve constructed from steel, stainless steel, high impact plastic, or other metals known to those of skill in the art, while the unitary receptacle head and insert liner may be prepared from a moldable plastic material that allows for the interference fit or wedging of a flared blade (not shown) on a post, e.g., 2450, into the insert liner portion.

Figure 25:
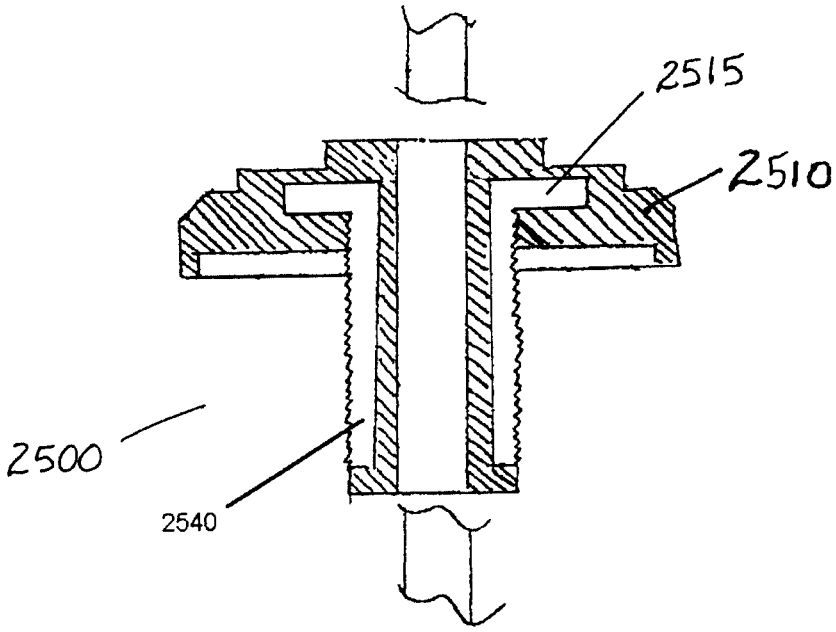
FIG. 25 is a fragmentary view in section of another alternate embodiment of a post receptacle with a receptacle head, where the threaded sleeve has a integrally formed head overmolded by the receptacle head.

FIG. 25 is a cross-sectional view of a post receptacle 2500 with a unitary receptacle head and insert liner 2510, according to one embodiment. Post receptacle 2500 is very similar to that of post receptacle 2400, with the addition of an anchoring head 2515 integrally formed with threaded sleeve 2540. The anchoring head 2515 provides a larger surface area for which to contact the receptacle head 2510, which is overmolded and encapsulates anchoring head 2515.

In FIGS. 21-24, the insert liners are illustrated as extending from the receptacle head to a distal end of the threaded sleeve, such that the insert liner is in contact with the length of the inner surface of the threaded sleeve. However, in alternative embodiments, the insert liners may be of an intermediate length such that the do not fully extend through the threaded sleeves. Such alternative embodiments are illustrated in FIGS. 26A, 26B, 26C, and 26D.

Figure 26A:
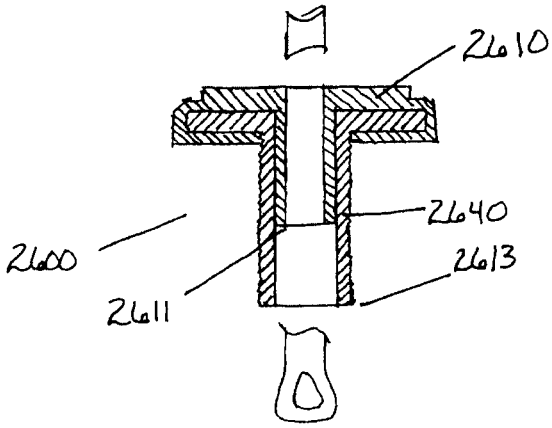
FIGS. 26A, 26B, 26C, and 26D are cross-sectional views of receptacle heads illustrating different liner ends, where the liner does not extend through the threaded sleeve, according to several embodiments.
Figure 26B:
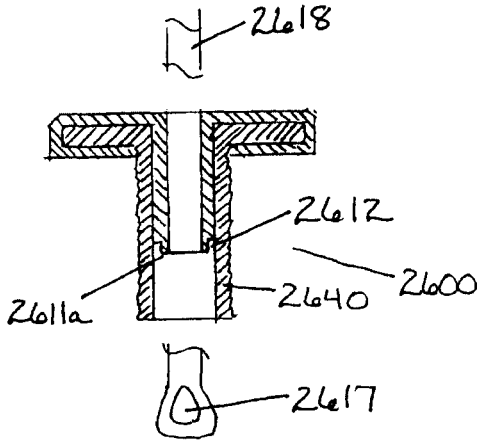
Figure 26C:
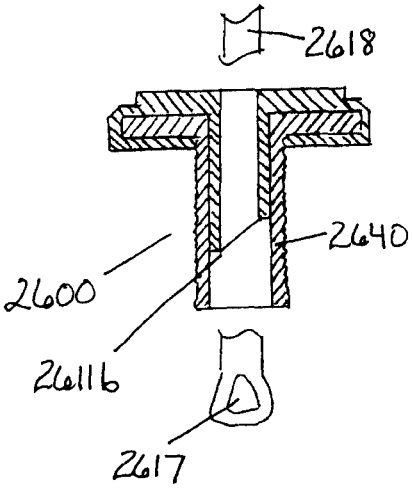
Figure 26D:
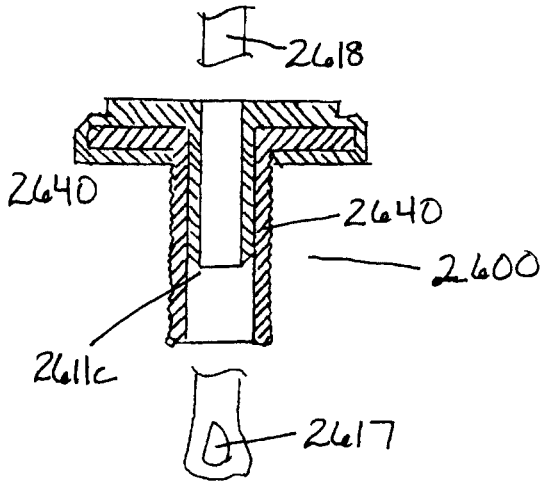

As shown in FIG. 26A, the receptacle 2600 has a unitary receptacle head and insert liner 2610 that has a distal end of the liner 2611 that does not fully extend the length of the threaded portion 2640. As illustrated, distal end of the liner 2611 has continuous contact with an inner surface of the threaded portion. In FIG. 26B, the distal end of the liner 2611*a* has a cut-out, or stepped configuration 2612 that allows for flexing of the distal end to accommodate the interference fit of a flared blade 2617 on the end of a securing post 2618. In FIG. 26C, the distal end of the liner 2611*b* is angled to allow for an alternate wedging interference fit of a flared blade 2617 on the end of a securing post 2618, within the receptacle. In FIG. 26D, the distal end of the liner 2611*c* is flare-cut, or beveled, to allow for flexing of the distal end to accommodate the interference fit of a flared blade 2617 on the end of a securing post 2618.

Figure 27:
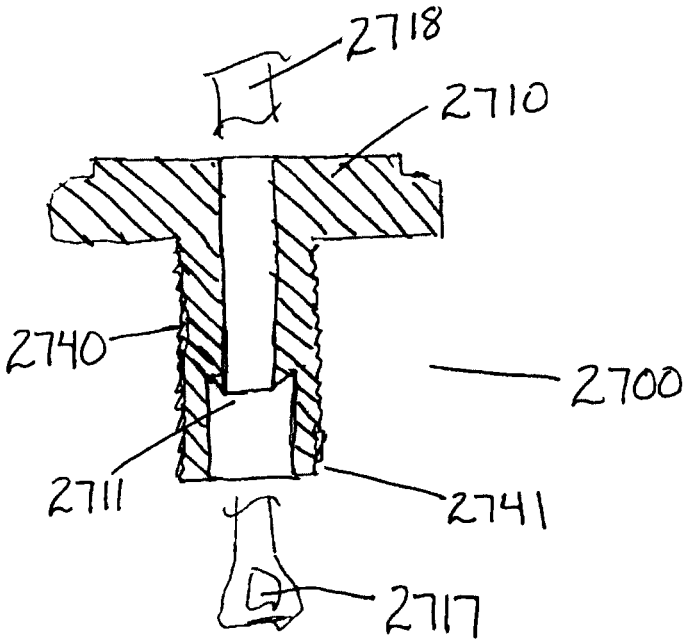
FIG. 27 is a fragmentary view in section of an alternate embodiment of a unitary post receptacle and head.

In yet another alternative embodiment, the receptacle head, threaded sleeve, and liner are all unitary, as illustrated in FIG. 27. In such an embodiment, a receptacle 2700, has a unitary structure of the head 2710 and "liner," where the "liner" does note extend fully (2711) to the distal end 2741 of the threaded portion 2740. As used with respect to this embodiment, "liner" refers to the portion of the unitary structure that performs the same function as an independent liner as those embodiments, such as, but not limited to, illustrated in FIGS. 26A-26D. In some embodiments, the "liner" has a distal end 2711 that provides flexibility to accommodate a flared blade end 2717 of a securing post 2718. The alternative configurations of the distal ends of the liners illustrated in FIGS. 26A-26D may likewise be used for distal end 2711.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A toilet comprising:

a toilet bowl having a bowl flange with apertures; a toilet seat including a seat ring and a seat mount, and seat mounting apparatus;

said seat mounting apparatus including said seat mount, post holders overlying the flange apertures, a connector joining said seat mount and said post holders to permit rotation of the seat ring between a generally horizontal use position and an over center storage position, and an elongate post secured to and extending downwardly from each of said post holders;

a post receptacle secured in each of the bowl flange apertures and extending there beyond; and a cylindrical receptacle retainer surrounding and engaging each post receptacle over most of its length and engaging the underside of the bowl to secure the post receptacle in the bowl flange aperture;

said elongate posts passing through and beyond the post receptacles, configured to permit the seat to be slidably elevated above the bowl flange to a maintenance position, and having a distal end configured to engage the receptacle in the maintenance position and to releasably support the elongate posts in said position for cleaning and maintenance;

wherein the post receptacle comprises a receptacle head, a threaded sleeve, and an insert liner.

2. The toilet of claim 1, wherein the threaded sleeve is a threaded metal sleeve.

3. The toilet of claim 2, wherein:

the receptacle head comprises a recessed area, and the post receptacle further comprises a nut configured to screw onto the threaded metal sleeve, and to be received by the recessed area of the receptacle head.

4. The toilet of claim 1, wherein the receptacle head and the insert liner are separate parts.

5. The toilet of claim 1, wherein the insert liner comprises a hollow shaft having a first end having a proximal shoulder and a second end having a distal shoulder.

6. The toilet of claim 1, wherein the insert liner comprises:

a hollow shaft having a first end and a second end, and a crush cut-out.

7. The toilet of claim 1 including a seat cover having a cover mount, said cover overlying said seat in the use position wherein:

said mounting apparatus includes said cover mount; and said connector joins said seat, cover and post holders to permit independent rotation of said seat ring and said seat cover between generally horizontal positions on said bowl flange and over center storage positions.

8. The toilet of claim 1, wherein the distal end comprises a flared blade of said elongate post.

9. The toilet of claim 1, wherein said elongate posts are secured to each of said post holders via a threaded end of each of said elongate posts and a threaded recessed area in each of said post holders.

10. The toilet of claim 1, wherein the seat mount comprises a hinge shroud, a hinge shroud sleeve, and a nest, said nest configured to receive the hinge shroud sleeve.

11. The toilet of claim 1, wherein each cylindrical receptacle retainer is engaged to each post receptacle via threading, and each cylindrical receptacle retainer is configured to be tightened on the each post receptacle to a torque of greater than 50 in-lbs.

12. A system for supporting and selectively positioning a toilet seat including a seat mount and a seat ring configured to rest on a toilet bowl flange having apertures, said system comprising:

a seat mounting apparatus including the seat mount, post holders overlying the bowl flange apertures, a connector joining said seat mount and the post holders to permit rotation of the seat ring between a generally horizontal use position and an over center storage position, and an elongate post secured to and extending downwardly from each of said post holders;

a post receptacle secured in each of the bowl flange apertures and extending there beyond;

a cylindrical receptacle retainer surrounding and engaging each post receptacle over most of its length and engaging the underside of the bowl flange to secure the receptacle in the flange aperture;

said elongate posts passing through and beyond the post receptacles, configured to permit the seat ring to be slidably elevated above the bowl flange to a maintenance position and having a distal end configured to engage the receptacle in the maintenance position and to releasably support the post in said position for cleaning and maintenance;

wherein each post receptacle comprises a receptacle head, a threaded sleeve, and an insert liner.

13. The system of claim 12 including a seat cover having a cover mount, said seat cover overlying said seat ring in the use position wherein:

said mounting apparatus includes said cover mount; and said connector joins said seat ring, seat cover and post holders to permit independent rotation of said seat ring and said seat cover between generally horizontal positions on said flange and over center storage positions.

14. The system of claim 12, wherein the distal end comprises a flared blade of said elongate post.

15. The toilet of claim 12, wherein said elongate posts are secured to each of said post holders via a threaded end of each of said elongate posts and a threaded recessed area in each of said post holders.

16. A toilet mounting hinge comprising:

post holders;

an elongate post secured to and extending downwardly from each of said post holders;

a post receptacle; and said elongate posts passing through and beyond said post receptacles and configured to permit a toilet seat to be slidably elevated above a toilet bowl to a maintenance position, and having a distal end configured to engage the receptacle in the maintenance position and to releasably support the elongate post in said maintenance position;

wherein:

each of said post receptacles comprises a receptacle head, a threaded metal sleeve, and an insert liner;

the receptacle head comprises a recessed area, and the post receptacle further comprises a nut configured to screw onto the threaded metal sleeve, and to be received by the recessed area of the receptacle head.

17. The toilet mounting hinge of claim 16, wherein the receptacle head, the insert liner, and the threaded metal sleeve are separate parts.

18. The toilet mounting hinge of claim 16, wherein the insert liner comprises a hollow shaft having a first end having a proximal shoulder and a second end having a distal shoulder.

19. The toilet mounting hinge of claim 16, wherein the insert liner comprises:

a hollow shaft having a first end and a second end, and a crush cut-out.

20. The toilet mounting hinge of claim 16, wherein:

the insert liner comprises a flexible distal end;

the threaded metal sleeve comprises a proximal end, a distal end, and a hollow shaft;

the receptacle head and insert liner are unitary;

the receptacle head engages the proximal end of the threaded metal sleeve and the insert liner engages the hollow shaft of the threaded metal sleeve; and the distal end of the insert liner does not extend to the distal end of the metal sleeve.

* * * * *